US005259125A

United States Patent [19]

Gromes

[11] Patent Number: 5,259,125

[45] Date of Patent: Nov. 9, 1993

[54] NON-SKID ATTACHMENT FOR ROOFER'S SHOE

[76] Inventor: Manuel C. Gromes, 17 Pannick Dr., Hamilton, N.J. 08610

[21] Appl. No.: 901,195

[22] Filed: Jun. 19, 1992

Related U.S. Application Data

[63] Continuation-in-part of Ser. No. 539,422, Jun. 18, 1990, abandoned.

[51] Int. Cl.[5] ..... A43B 23/28

[52] U.S. Cl. ..... 36/59 C; 36/7.5; 36/7.7; 36/59 R

[58] Field of Search ..... 36/113, 116, 72 R, 59 R, 36/7.2, 7.4, 7.5, 7.6, 7.7, 11.5, 59 C

[56] References Cited

U.S. PATENT DOCUMENTS

| | | | |
|---|---|---|---|
| 987,054 | 3/1911 | Eves | 36/113 X |
| 1,030,892 | 7/1912 | Kennedy | 36/72 R |
| 1,747,603 | 2/1930 | Ruth | 36/59 R |
| 2,189,489 | 2/1940 | Fritz | 36/7.6 |
| 2,333,303 | 11/1943 | Enos | 36/59 R X |
| 2,644,249 | 7/1953 | Stern | 36/72 R X |
| 2,685,141 | 8/1954 | Davenport | 36/7.6 |
| 3,099,885 | 8/1963 | Jordan et al. | 36/59 R |
| 3,574,958 | 4/1971 | Martuch | 36/116 |
| 4,638,574 | 1/1987 | Roda | 36/7.2 |

*Primary Examiner*—Steven N. Meyers
*Assistant Examiner*—BethAnne Cicconi
*Attorney, Agent, or Firm*—Abdallah & Muckelroy

[57] ABSTRACT

A roofer's attachment for shoes to provide secure footing while working on a sloping roof and the like. The attachment preferably includes a rigid half sole having a slip-resistant material on the bottom surface, an instep strap attached to the sides of the half sole, a rigid toe member that biases the toe portion of the half sole against the roof and prevents curling and a heel strap to secure the attachment to the roofer's shoe. The material on the bottom surface of the half sole is preferably formed from medium weave indoor/outdoor carpet. The toe member is preferably made of a rigid material such as Teflon or a suitably curved piece of steel and the half sole is made of hard plastic or hardened leather with the carpet attached underneath.

4 Claims, 1 Drawing Sheet

NON-SKID ATTACHMENT FOR ROOFER'S SHOE

This application is a continuation-in-part of a copending application of Manuel C. Gromes, Ser. No. 07/539,422, filed on Jun. 18, 1990, now abandoned.

FIELD OF THE INVENTION

The present invention generally relates to non-skid shoes and shoe attachments. More particularly, the present invention relates to non-skid roofer's attachments for shoes to enable safe walking on asphalt shingles of roofs without slipping.

BACKGROUND OF THE INVENTION

The dangers to carpenters, shinglers, painters and the like while working on sloping and other roofs are generally known. These workers assume various positions on a roof and can easily fall either on the roof or from the roof if sufficiently gripping shoe means are not utilized. Roofers and the like not only work in various positions on the roof, but also must go back and forth between the roof and the ground surface to do their jobs. Thus, the shoes that they wear must be suitable for different types of surfaces and must be constructed so that the gripping effectiveness is not impaired by either upward an downward movement or the numerous travels between the different types of surfaces encountered. Hence, a gripping surface that uses a "sticky" adhesive is not practical. A suction cup arrangement does not work well either because of the graininess of the asphalt.

Asphalt roof shingles, as manufactured by Owen's Corning and Georgia Pacific, for example, are widely used in present-day roof constructions. These roof shingles are generally formed having various grades of stone gravel embedded in a sheet of petroleum-based, marginally flexible material. The embedded gravel is provided in fine, medium and course grains. Therefore, a need exists for a roofer's shoe suitably formed to grip the various granular surfaces of asphalt roof shingles.

The anti-slip footwear of the prior art has been directed to gripping problems associated with wet or slippery ground, slippery underwater rocks, wet or greasy floors, icy and snowy sidewalks and streets and the aforementioned problems encountered by roof workers.

Exemplary of the underwater wet rocks, wet ground and greasy floor anti-slip footwear are U.S. Pat. No. 3,574,958 to Martuch, U.S. Pat. No. 1,490,107 to Hale, and U.S. Pat. No. 2,193,943 to Shea. The Hale patent discloses the use of knobby alligator skin to form the sole of a shoe. In the Shea patent the sole of the shoe is constructed having longitudinally and transversely extending grooves formed in fabric-reinforced vulcanized rubber.

U.S. Pat. No. 2,258,322 to Frolich discloses an anti-skid shoe attachment having a cloth member integrally formed with elastic bands to prevent accumulation of snow and ice particles. U.S. Pat. No. 2,547,812 to Carabatsos discloses a canvas-soled anti-slip footwear attachment, the cross ribs or corrugations of the canvas providing the effective anti-slip surface. A further anti-slip footwear attachment useful on icy streets is disclosed in U.S. Pat. No. 4,372,056 to Benaquista comprising a ribbed non-skid half sole attachable to a shoe by elastic straps.

Martuch is noteworthy in that it discloses the use of indoor-outdoor carpeting as an underwater sole because of its nonwettable, nonwater-retaining properties. However, Martuch does not suggest any advantage in an unsubmerged situation or in a situation such as a grainy surface where it would be expected that the carpet on an inclined surface would exert a vector force sufficient to dislodge surface grains rather than supply an extraordinary synergistic gripping power.

Roofer's shoes and shoe attachments disclosed in the prior art generally comprise a complex structure and are unsuitable for travel back and forth between the roof and the ground surface. In U.S. Pat. No. 987,054 to Eves a roofer's shoe is disclosed having pointed spurs extending downwardly at an acute angle from the flanges, heel and sole of the shoe. U.S. Pat. No. 1,070,951 to Elliott discloses a roofer's shoe attachment made adjustable to various shoe sizes and shapes by the combination of a plurality of segmented plates, each plate having a series of downwardly-extending teeth formed therein. U.S. Pat. No. 1,103,108 to Van Wie discloses a roofer's shoe having a shoe sole formed by a plurality of spikes or other protuberances extending downwardly from a flexible steel sheet plate. And, in U.S. Pat. No. 2,628,437 to Forsythe an anti-slip shoe attachment is disclosed having a sole formed from a flexible sheet of course-grained abrasive material.

While the various anti-slip shoes and shoe attachments of the prior art provide some degree of safety from accidental falls, these devices are unsuitable for working on inclined asphalt roof shingles. Furthermore, the devices of the prior art do not provide an appropriate shoe sole surface suitable for wear on concrete ground surfaces as well on roofs. Also, the invasive gripping means of some of the prior art devices would destroy the asphalt roof shingles widely used in modern-day roof constructions.

SUMMARY OF THE INVENTION

The present invention discloses an anti-slip attachment for a roofer's shoe comprising a half sole having an instep strap, a toe strap and a heel strap. The half sole is semi-rigid or substantially rigid and the toe strap is rigid or both are rigid. The half sole has a bottom surface formed from an indoor-outdoor carpet material having a coefficient of friction that resists slippage between the half sole bottom surface and all varieties of grainy asphalt roof shingles. The carpet material is attached to a semi-rigid leather sole or a rigid plastic sole. The toe strap biases the forward portion of the half sole to maintain the half sole, if semi-rigid, in planar disposition with the roof surface or acts in concert with a rigid half sole to perform this function to an even greater degree on the combination of a rigid half sole and rigid toe strap.

OBJECTS OF THE INVENTION

An object of the present invention is to provide an anti-slip roofer's attachment for shoes to make the shoes adapted for working on inclined asphalt roof shingles.

Another object of this invention is to provide an anti-slip attachment for roofer's shoes that can be easily and securely attached to the shoes.

A further object of the invention is to provide a roofer's shoe attachment that can be worn on a roof and on the ground or surrounding concrete pavement or slab without impairing the anti-slip quality of the attachment.

It is also an object of this invention to provide a roofer's shoe attachment that maintains a planar disposition of the bottom surface of the attachment to increase the surface area of contact with the roof surface and to avoid slipping and/or tripping due to a downwardly and/or backwardly curled toe.

A still further object of the present invention is to provide a roofer's shoe attachment having means to prevent backward, downward and upward curling of the toe portion of the shoe attachment.

Yet another object of the invention is to provide an attachment for a roofer's shoe that provides tremendous gripping power on any inclined grainy asphalt shingled roof.

These and other objects of the present invention will be apparent to those skilled in the art from the following description of a preferred embodiment, claims and appended drawings.

DESCRIPTION OF A PREFERRED EMBODIMENT

Figure 1:
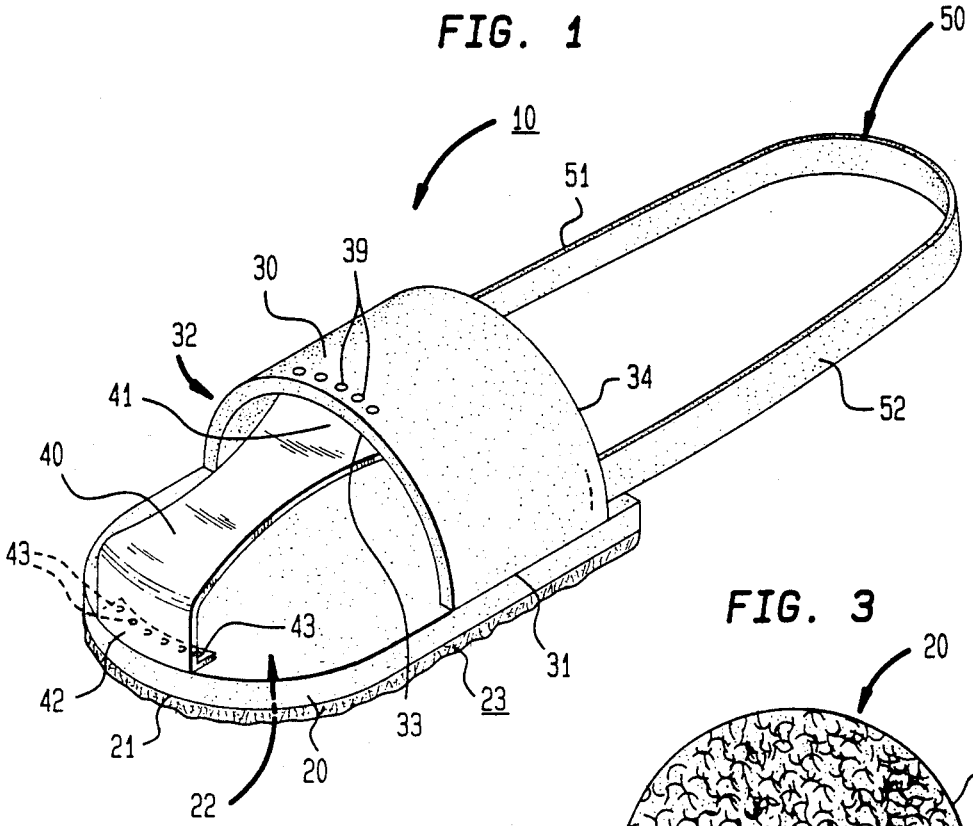
FIG. 1 is a top perspective view of the anti-slip shoe attachment of the present invention.

FIG. 1 illustrates in a top perspective view the anti-slip shoe attachment 10 of the present invention. The attachment 10 includes a half sole 20, an instep strap 30, a toe member 40 and a heel strap 50. The shoe attachment 10 fits about the toe and heel of a roofer's shoe (not shown), the half sole 20 being disposed below the sole of the roofer's shoe. The half sole 20 is preferably rigid but may be still and accomplish the novel functions of the invention to a lesser degree.

The instep strap 30 is fixedly attached at its respective ends 31, 32 to the sides of said half sole 20. Instep strap 30 is preferably formed from a resilient material, such as elasticized cloth or soft leather, for example, to provide snug and secure fitting of the attachment device 10 about the roofer's shoe.

The half sole 20 is preferably rigid being made of thick, stiff plastic. Alternatively the half sole 20 may be semi-rigid and substantially inflexible by being made of hardened leather, PVC plastic about 5/16 inches thick for example.

Toe member 40 is fixedly attached by rivets 39, for example, at its upper end 41 to the forward side edge 33 of the instep strap 30 and by rivets 43, for example, at its lower end 42 to the toe portion 21 of the half sole 20. The strap 40 is preferably formed from a downwardly-biasing totally rigid material, such as Teflon TM or steel, for example, which functions to maintain the toe portion 21 of the attachment 10 in planar disposition with the roof surface when worn by forcing the toe portion 21 slightly downward and yet prevent the toe portion 21 from curling upwards.

Figure 2:
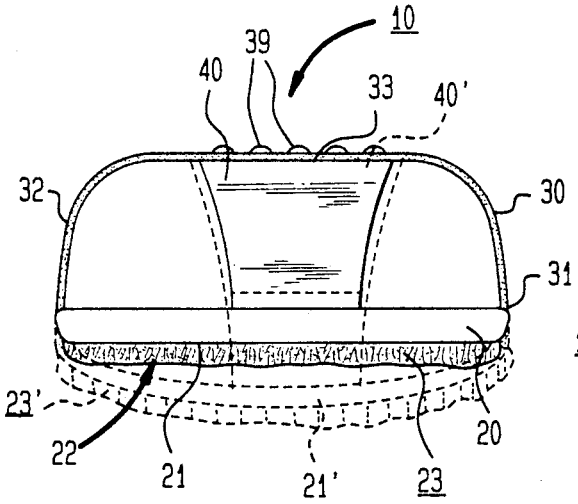
FIG. 2 is a front plan view of the anti-slip shoe attachment.

The toe portion of shoes and shoe attachments having a flexible sole tends to curl downwardly or upwardly after extensive wear, as indicated in FIG. 2 by the phantom illustration of the toe portion 21', which creates a tripping and/or slipping hazard. The downwardly-biasing toe member 40 of the present shoe attachment 10 in combination with a rigid half sole 20 prevents the curling of the toe portion 21 to eliminate these hazards by maintaining the sole 20 of the attachment 10 in planar disposition with an inclined roof surface whether a roofer is walking upward or downward.

As a further result, the maximum area possible of the bottom surface 22 remains in contact with the roof surface whether the roofer is walking up or down an asphalt roof.

The heel strap 50 of the shoe attachment 10 comprises a length of a durable, strong material such as leather, for example, having right and left ends 51 and 52. The left end 51 and the right end 52 of the heel strap 50 are respectively attached to opposing sides of the rearward edge 34 of the instep strap 30.

Figure 3:
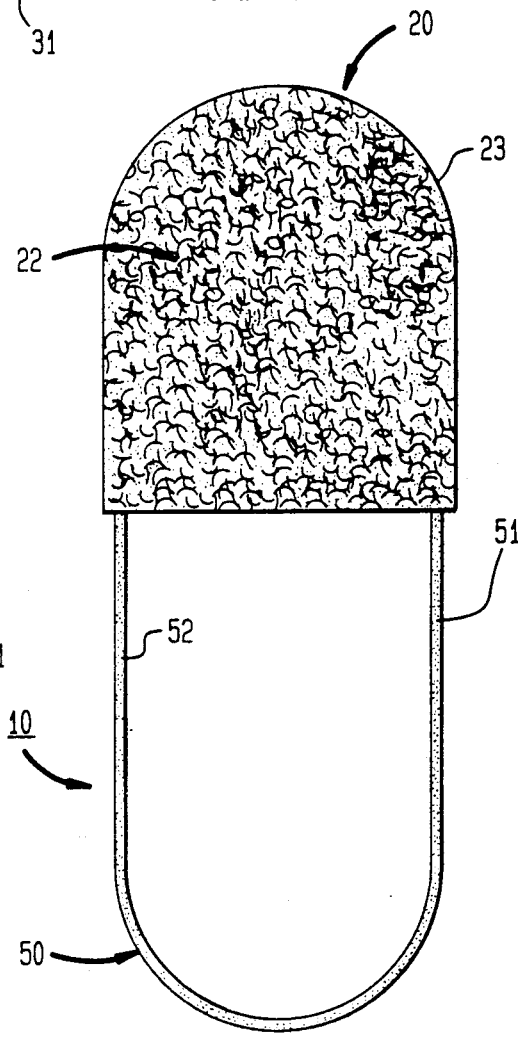
FIG. 3 is a bottom plan view of the anti-slip shoe attachment.

FIG. 3 illustrates in a bottom plan view the bottom surface 22 of the half sole 20 of the shoe attachment 10 of the present invention. Bottom surface 22 is formed from indoor-outdoor carpeting 23. Such carpeting 23 is glued or epoxied, for example, to sole 20 and makes the bottom surface 22 tremendously resistant to slippage between the attachment 10 and an inclined surface of asphalt roof shingles, the primary roofing material utilized in modern inclined roof constructions. All weather or indoor/outdoor medium weave for the carpeting 23 has shown itself to be suitable to meet this requirement. Utilizing medium weave indoor/outdoor texture for the carpet 23 on the bottom surface 22 of the half sole 20 is preferable over all other types as this type alone has shown extraordinary gripping power over other types. The carpet 23 further provides a walking surface for the attachment 10 that is also suitable for walking on dirt, grass, wet grass, concrete pavements or slabs without significantly impairing the gripping power of the attachment 10.

The manner in which the shoe attachment 10 of the present invention is attached to a roofer's shoe to provide anti-slip walking means should be readily understood from the foregoing description of its construction.

Various changes and modifications may be made to the present shoe attachment 10 including adding its essential features directly to a shoe to make an integral shoe without departing from the spirit and scope of this invention as set forth in the appended claims, to wit:

What is claimed is:

1. An anti-slip attachment for a worker's shoe having a front portion to provide secure footing for roofers while walking on an inclined roof of asphalt shingles, said attachment comprising a non-slip rigid half-sole having a left rearward side portion, a right rearward side portion, a toe portion, a top surface and a bottom surface, said half sole being disposed at the front portion of a shoe on which the attachment is to be worn; a flexible in-step strap having a rearward side edge, a forward side edge, and two ends, said in-step strap being fixedly attached at the respective ends to the left rearward side portion and right rearward side portion of said rigid half sole, respectively; a rigid toe strap having two ends opposite each other, one end being attached to said in-step strap and the opposite end being attached to said half sole, said rigid toe strap being fixedly attached at its respective ends to the forward side edge of said in-step strap and to the toe portion of said half sole, said rigid toe strap downwardly biasing the toe portion of said half sole, said half sole being substantially inflexible such that when the attachment is worn on a shoe said toe strap forces said half sole slightly downward to maintain a planar disposition of said sole against adjacent inclined asphalt roof shingles, and a heel strap having two ends, said heel strap being fixedly attached at its two respective ends to the rearward side edge of said in-step strap wherein the bottom surface of said half sole comprises a material having a coefficient of friction such that said material resists slippage between said bottom surface and the inclined asphalt roof shingles and wherein the coefficient of friction of said material of the bottom surface of said half sole is such that said material further resists slippage between said bottom surface and a concrete pavement, said rigid non-slip half sole further including a bottom surface comprising indoor-outdoor carpet.

2. An anti-slip attachment as described in claim 1 wherein the bottom surface of said non-slip half sole consists substantially of medium weave indoor-outdoor carpet.

3. An anti-slip device attachable to a shoe to provide secure footing for roof workers, said device comprising a non-slip half sole having a left rearward side portion, a right rearward side portion, a toe portion, a top surface and having a bottom surface formed from indoor-/outdoor carpet; an instep strap having two ends, a rearward side edge, and a forward side edge, said instep strap being fixedly attached at its respective ends to the rearward side portions of said half sole; a substantially rigid toe strap having two ends opposite each other, one end being attached to said instep strap and the opposite end being attached to said half sole, said toe strap being fixedly attached at one end to the forward side edge of said instep strap and at the opposite end to the toe portion of said half sole, said toe strap being formed of a substantially rigid material to prevent curling of the toe portion of said half sole; and a heel strap having a right end and a left end, said heel strap being fixedly attached at the right and left ends thereof to opposing rearward side edges of said instep strap, said heel strap being engagable with a roofer's foot, said half sole being sufficiently inflexible such that the toe portion of said half sole is maintained in planar disposition with a roof surface by biasing from said toe strap.

4. A roofer's shoe as described in claim 3 wherein said indoor/outdoor carpet is a medium weave carpet.

* * * * *